US010964999B2

(12) United States Patent
Su et al.

(10) Patent No.: US 10,964,999 B2
(45) Date of Patent: Mar. 30, 2021

(54) MOUNTING STRUCTURE, ANTENNA DEVICE AND METHOD FOR ASSEMBLING ANTENNA DEVICE

(71) Applicant: CommScope Technologies LLC, Hickory, NC (US)

(72) Inventors: Ruixin Su, Jiangsu (CN); ZhaoHui Liu, Jiangsu (CN)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 16/360,466

(22) Filed: Mar. 21, 2019

(65) Prior Publication Data

US 2019/0305400 A1 Oct. 3, 2019

(30) Foreign Application Priority Data

Mar. 29, 2018 (CN) ..... 2018 1 0270104

(51) Int. Cl.
*H01Q 1/12* (2006.01)
*H01R 43/20* (2006.01)
*H01R 9/18* (2006.01)

(52) U.S. Cl.
CPC ..... *H01Q 1/12* (2013.01); *H01R 9/18* (2013.01); *H01R 43/20* (2013.01)

(58) Field of Classification Search
CPC ..... H01Q 1/12; H01Q 1/1207; H01R 43/20; H01R 9/18; H01R 13/6315; H01R 2201/02; H01R 13/518
(Continued)

(56) References Cited

U.S. PATENT DOCUMENTS 6,140,596 A * 10/2000 Tsay ..... H01H 13/52 200/406
7,592,960 B2 * 9/2009 Byrne ..... H01Q 1/1271 343/711
(Continued)

FOREIGN PATENT DOCUMENTS

KR 101113825 2/2012
KR 101387778 4/2014

OTHER PUBLICATIONS

International Search Report and Written Opinion corresponding to International Application No. PCT/US2019/019369 dated Jun. 12, 2019.
(Continued)

*Primary Examiner* — Muhammad Ijaz
(74) *Attorney, Agent, or Firm* — Myers Bigel, P.A.

(57) ABSTRACT

The present disclosure discloses a mounting structure, an antenna device and a method for assembling the antenna device. The mounting structure is used for mounting a connector to a first fixing part and a second fixing part, and comprises: a main body portion which defines a hollow cavity for receiving the connector, a first flange arranged on an upper surface of the main body portion around the hollow cavity and a second flange arranged on the upper surface of the main body portion around the first flange and spaced apart from the first flange; a protective pad received in a protective pad receiving portion defined between the first flange and the second flange; a supporting component to be fixed to the second fixing part, the main body portion being fitted within the supporting component; and at least one fastener used for fastening the mounting structure to the first fixing part, so that the first flange comes into direct contact with the lower surface of the first fixing part.

15 Claims, 4 Drawing Sheets

(58) Field of Classification Search
USPC ..... 248/225.11; 343/872, 873
See application file for complete search history.

(56) References Cited

U.S. PATENT DOCUMENTS

| | | | | |
|---|---|---|---|---|
| 7,758,383 | B1 * | 7/2010 | Chantrell | H01R 13/65917 439/607.41 |
| 2004/0252063 | A1 * | 12/2004 | Sadamori | H01Q 1/38 343/702 |
| 2011/0189889 | A1 | 8/2011 | Wang | |
| 2014/0213122 | A1 * | 7/2014 | Shen | H01R 24/50 439/784 |
| 2014/0287631 | A1 * | 9/2014 | Tashiro | H01R 43/20 439/733.1 |
| 2017/0214133 | A1 * | 7/2017 | Orem | H01Q 1/427 |
| 2017/0373378 | A1 | 12/2017 | Dickerson et al. | |
| 2018/0309184 | A1 * | 10/2018 | Iwakami | H01Q 1/20 |
| 2019/0305400 | A1 * | 10/2019 | Su | H01Q 1/12 |
| 2020/0122657 | A1 * | 4/2020 | Goto | H01R 9/223 |

OTHER PUBLICATIONS

International Preliminary Report on Patentability corresponding to International Application No. PCT/US2019/019369 dated Oct. 8, 2020.

* cited by examiner

MOUNTING STRUCTURE, ANTENNA DEVICE AND METHOD FOR ASSEMBLING ANTENNA DEVICE

RELATED APPLICATION

The present application claims priority from and the benefit of Chinese Patent Application No. 201810270104.2, filed Mar. 29, 2018, the disclosure of which is hereby incorporated herein by reference in its entirety.

FIELD OF THE INVENTION

The present disclosure generally relates to the field of wireless communication. More specifically, the present disclosure relates to a mounting structure for mounting a connector (e.g., a radio frequency connector) to a first fixing part and a second fixing part, an antenna device including the mounting structure, and a method for assembling the antenna device.

BACKGROUND OF THE INVENTION

In the field of wireless communication, many antennas (e.g. sector antennas) are mounted outdoors, and in order to reduce the maintenance work, the sector antenna should have reliable anti-electromagnetic interference performance and protection performance (for example, reaching the IP65 protection level).

An aluminum extrusion frame is generally arranged on the back of the antenna to allow cooperation with a blind mate connector. The connector should be precisely located in the extrusion frame. Multiple connectors (e.g., radio frequency connectors) need to be connected to the inner core of the antenna before the extrusion frame is installed in order to perform RF (radio frequency) testing. Many mounting structures are known in the prior art, but these mounting structures cannot typically ensure reliable protection performance and/or anti-electromagnetic interference performance after the extrusion frame is mounted. In addition, the mounting work using these mounting structures is relatively complex, particularly when multiple connectors need to be mounted.

SUMMARY OF THE INVENTION

One objective of the present disclosure is to provide a mounting structure that can overcome at least one shortcoming in the prior art, an antenna device including the mounting structure, and a method for assembling the antenna device.

According to a first aspect of the present disclosure, a mounting structure for mounting a connector to a first fixing part and a second fixing part is provided, characterized in that the mounting structure comprises a main body portion which defines a hollow cavity for receiving the connector, a first flange arranged on an upper surface of the main body portion around the hollow cavity and a second flange arranged on the upper surface of the main body portion around the first flange and spaced apart from the first flange. The mounting structure further comprises: a protective pad received in a protective pad receiving portion defined between the first flange and the second flange; a supporting component to be fixed to the second fixing part, the main body portion being fitted within the supporting component; and at least one fastener used for fastening the mounting structure to the first fixing part, so that the first flange comes into direct contact with the lower surface of the first fixing part.

According to the first aspect, the second flange is slightly lower than the first flange (for example, the second flange is at least 0.1 mm lower than the first flange), so that after the at least one fastener fastens the mounting structure to the first fixing part, only the first flange is in direct contact with the lower surface of the first fixing part. Therefore, a situation in which the second flange is higher than the first flange due to manufacturing tolerance, and accordingly the first flange cannot form good surface contact with the lower surface of the first fixing part, can be prevented. A gasket, for example, a gasket made of a plastic material, can be arranged between the second flange and the lower surface of the first fixing part.

According to the first aspect, preferably, the mounting structure further comprises an adhesion component used for adhering the protective pad into the protective pad receiving portion.

According to the first aspect, preferably, the mounting structure further comprises: at least one vertical locating portion arranged on the lower surface of the main body portion, and the at least one vertical locating portion is in clearance fit with at least one vertical location fit portion arranged in the supporting component, so that the at least one vertical locating portion is movable in at least one direction relative to the at least one vertical location fit portion.

According to the first aspect, preferably, the mounting structure further comprises: at least one horizontal locating portion arranged on a side face of the main body portion; and at least one elastic arm extending upward from the supporting component, wherein a horizontal location fit portion is arranged on the elastic arm, and the at least one horizontal locating portion is in clearance fit with the horizontal location fit portion, so that the at least one horizontal locating portion is movable in at least one direction relative to the at least one horizontal location fit portion.

According to the first aspect, preferably, the connector is in interference fit in the hollow cavity or is integrally formed within the hollow cavity with the main body.

According to the first aspect, preferably, both of the main body portion and the first fixing part are made of metals.

According to the first aspect, preferably, the supporting component is made of a plastic material.

According to the first aspect, preferably, the connector is in conductive contact with the main body portion.

According to a second aspect of the present disclosure, an antenna device is provided, characterized in that the antenna device comprises: at least one mounting structure mentioned above; and the first fixing part and the second fixing part, wherein the mounting structure fixes the connector to the first fixing part and the second fixing part.

According to the second aspect, preferably, the antenna device comprises multiple rows of mounting structures for fixing multiple rows of connectors to the first fixing part and the second fixing part.

According to a third aspect of the present disclosure, a method for assembling an antenna device is provided, characterized in that the method comprises the following steps: 1) providing at least one mounting structure mentioned above; 2) fixing the supporting component to the second fixing part; 3) placing the protective pad into the protective pad receiving portion; 4) inserting the main body portion into the supporting component; and 5) fastening the first fixing part to the main body portion via the at least one fastener.

According to the third aspect, preferably, the provided mounting structure comprises an adhesion component, and the step 3) comprises: adhering the protective pad into the protective pad receiving portion via the adhesion component.

According to the third aspect, preferably, the provided mounting structure further comprises: at least one vertical locating portion arranged on the lower surface of the main body portion, and the at least one vertical locating portion is in clearance fit with at least one vertical location fit portion arranged in the supporting component, so that the at least one vertical locating portion is movable in at least one direction relative to the at least one vertical location fit portion, and moreover, the step 4) further comprises the following steps: forming clearance fit between the at least one vertical locating portion and the at least one vertical location fit portion arranged in the supporting component, so that the at least one vertical locating portion is movable in at least one direction relative to the at least one vertical location fit portion.

According to the third aspect, preferably, the provided mounting structure further comprises: at least one horizontal locating portion arranged on a side face of the main body portion; and at least one elastic arm extending upward from the supporting component, wherein a horizontal location fit portion is arranged on the elastic arm, and the at least one horizontal locating portion is in clearance fit with the horizontal location fit portion, so that the at least one horizontal locating portion is movable in at least one direction relative to the at least one horizontal location fit portion, and moreover, the step 4) further comprises the following steps: forming clearance fit between the at least one horizontal locating portion and the horizontal location fit portion, so that the at least one horizontal locating portion is movable in at least one direction relative to the at least one horizontal location fit portion.

According to the third aspect, preferably, prior to the step 5), the steps 1) to 4) are repeated, until all mounting structures are mounted.

According to the third aspect, preferably, the method further comprises providing at least one connector, wherein the connector is located, integrally with the main body portion, in the hollow cavity of the main body portion, or the connector is inserted into the hollow cavity of the main body portion as a separate component in an interference fit manner.

BRIEF DESCRIPTION OF THE DRAWINGS

After reading the specific embodiments below in combination with the drawings, multiple aspects of the present disclosure will be better understood, wherein.

DETAILED DESCRIPTION OF THE EMBODIMENTS

Figure 1A:
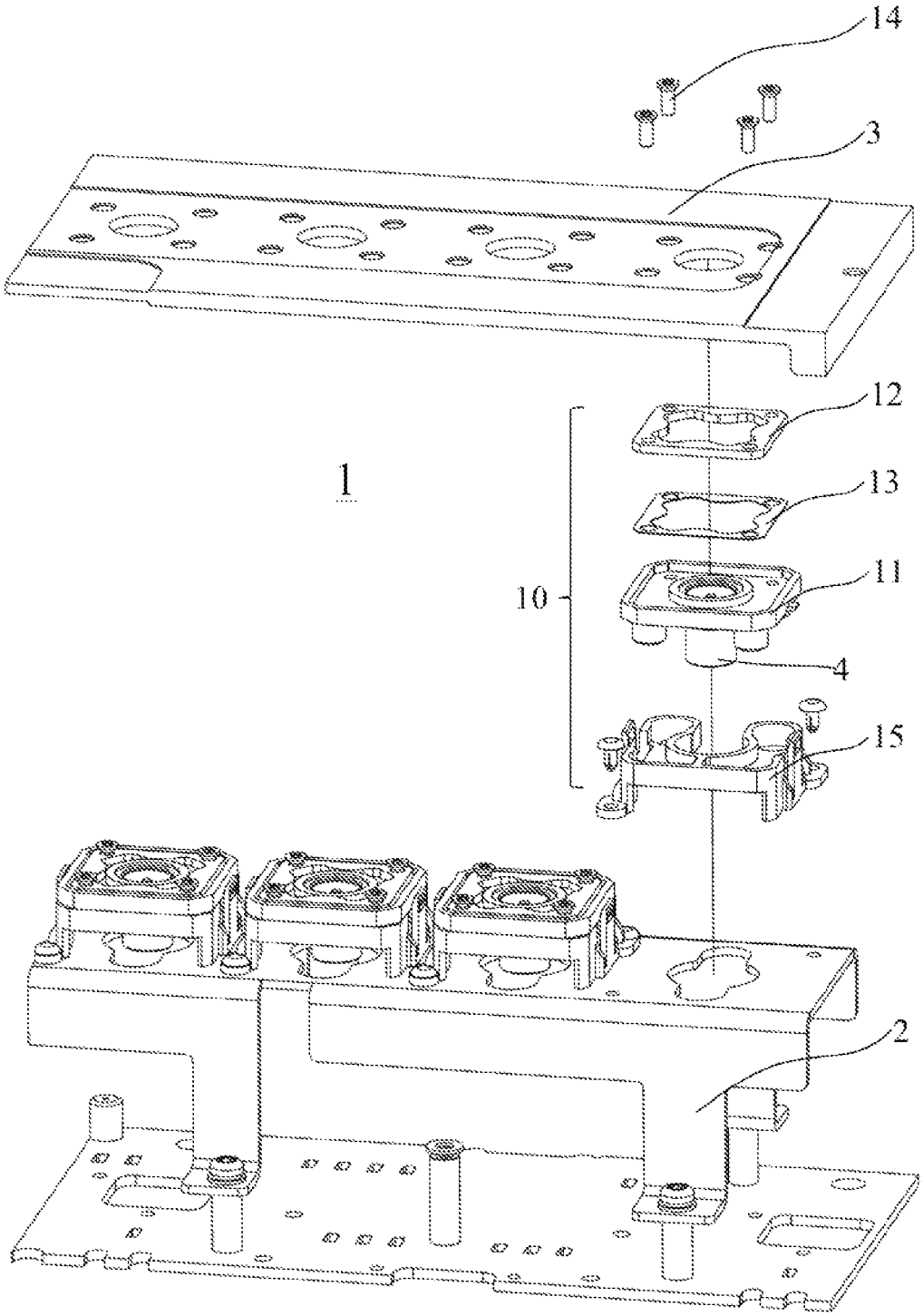
FIG. 1A is an exploded view of an antenna device according to a first embodiment of the present disclosure, showing the antenna device provided with four mounting structures according to the present disclosure.

The present disclosure will be described below with reference to the drawings, and the drawings herein illustrate several embodiments of the present disclosure. However, it should be understood that the present disclosure can be presented in a variety of different ways, is not limited to the embodiments described below; in fact, the embodiments described below are intended to make the present disclosure more complete and fully illustrate the protection scope of the present disclosure to those skilled in the art. It should also be understood that the embodiments disclosed herein can be combined in a variety of ways to provide more additional embodiments.

It should be understood that, the same reference signs represent the same elements throughout the drawings. In the drawings, the sizes of some features can be modified for the sake of clarity.

It should be understood that the terminologies in the specification are only used for describing specific embodiment, rather than limiting the present disclosure. All the terms (including technical terms and scientific terms) used in the specification have meanings generally understood by those skilled in the art, unless otherwise defined. For the sake of simplicity and/or clarity, well-known functions or structures may be not explained in detail.

The singular forms "one", "the" and "the" used in the specification include the plural forms unless clearly specified. The terms "comprising", "including" and "containing" indicate the presence of alleged features, but do not exclude the presence of one or more other features. The terms "and/or" used in the specification include any and all combinations of one or more of related listed items. The terms "between X and Y" and "approximately between X and Y" used in the specification should be interpreted to include X and Y. The term "between about X and Y" used in the specification means "between about X and about Y", and the term "from about X to Y" used in the specification means "from about X to about Y".

In the specification, when one element is described as located "on" another element, "attached" to another element, "connected" to another element, "coupled" to another element, or in "contact" with another element, the element can be directly located on the other element, attached to the other element, connected to the other element, coupled to the other element or in contact with the other element, or an intermediate element can be present. In contrast, when one element is described as "directly" located "on" the other element, "directly attached" to the other element, "directly connected" to the other element, "directly coupled" to the other element, or in "direct contact" with the other element, no intermediate element is present. In the specification, that one feature is arranged to be "adjacent to" the other feature can mean that one feature has a part overlapped with the adjacent feature or a part located above or below the adjacent feature.

In the specification, spatial relationship terminologies, such as "above", "below", "left", "right", "front", "back", "high" and "low" and the like can illustrate the relationship between one feature and the other feature in the drawings. It should be understood that the spatial relationship terminologies, in addition to containing the orientations as shown in the drawings, further include different orientations of the device in use or operation. For example, when the device in the drawings is inverted, the original features described as "below" the other features, can be described as "above" the other features in this case. The device can be located in other ways (rotated for 90 degrees or in other directions), and the relative spatial relationship is correspondingly explained in this case.

Figure 2:
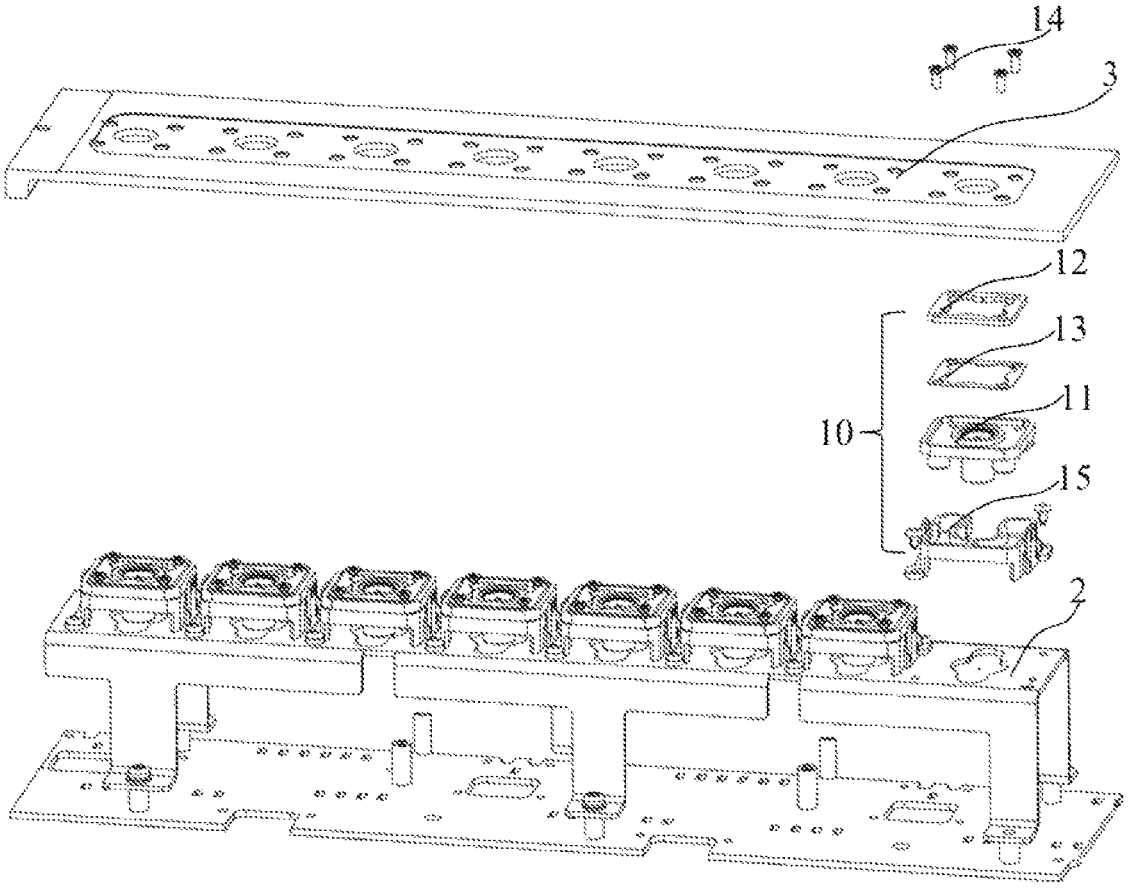
FIG. 2 is an exploded view of an antenna device according to the first embodiment of the present disclosure, showing the antenna device is provided with eight mounting structures according to the present disclosure.
Figure 3:
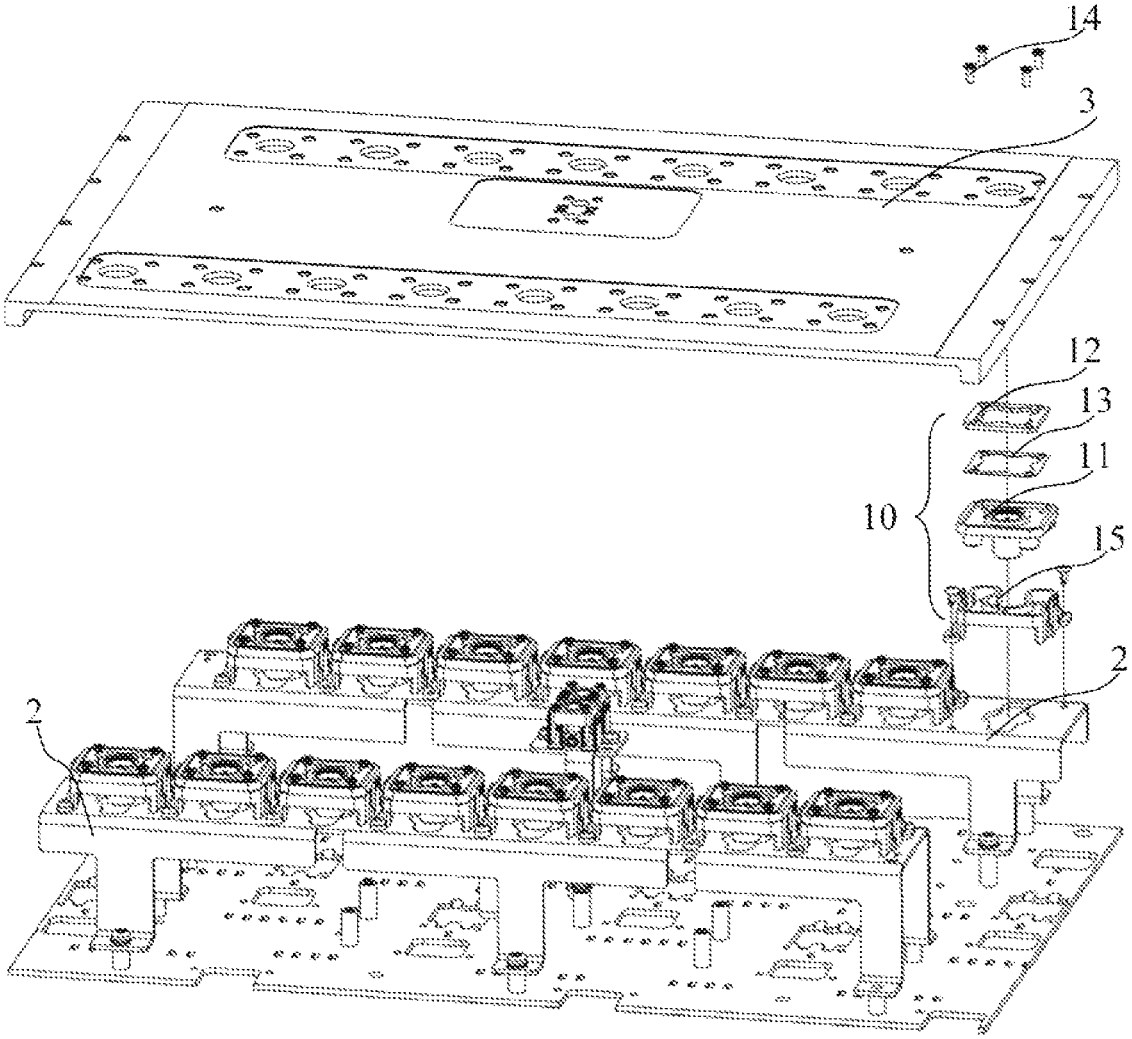
FIG. 3 is an exploded view of an antenna device of the first embodiment of the present disclosure, showing the antenna device is provided with sixteen mounting structures according to the present disclosure.

FIG. 1A shows main components of an antenna device 1 of the present disclosure, and it comprises a mounting structure 10 of the present disclosure. As an example, the antenna device 1 in FIG. 1A is a sector antenna. It should be understood that the present disclosure is not limited to be applied to the sector antenna as shown in FIG. 1A, but can be applied to any other type of antenna device. In addition, the antenna device 1 as shown in FIG. 1A comprises four mounting structures 10. It should be understood that the antenna device 1 can comprise any number of mounting structures 10, for example, eight mounting structures 10 (referring to FIG. 2), and sixteen mounting structures 10 (referring to FIG. 3). It should be noted that FIG. 1 and FIG. 2 show mounting structures arranged in a single row, FIG. 3 shows mounting structures arranged in double rows, but it should be understood that the present disclosure is applicable to the mounting structures arranged in more rows.

As shown in FIG. 1A, in addition to the mounting structure 10 mentioned above, the antenna device 1 of the present disclosure further comprises a bracket 2 and a frame 3, and the mounting structure 10 is used for fixing a connector 4 to the bracket 2 and the frame 3. The frame 3 may be made of aluminum. As an example, the connector 4 can be a radio frequency connector.

Figure 1B:
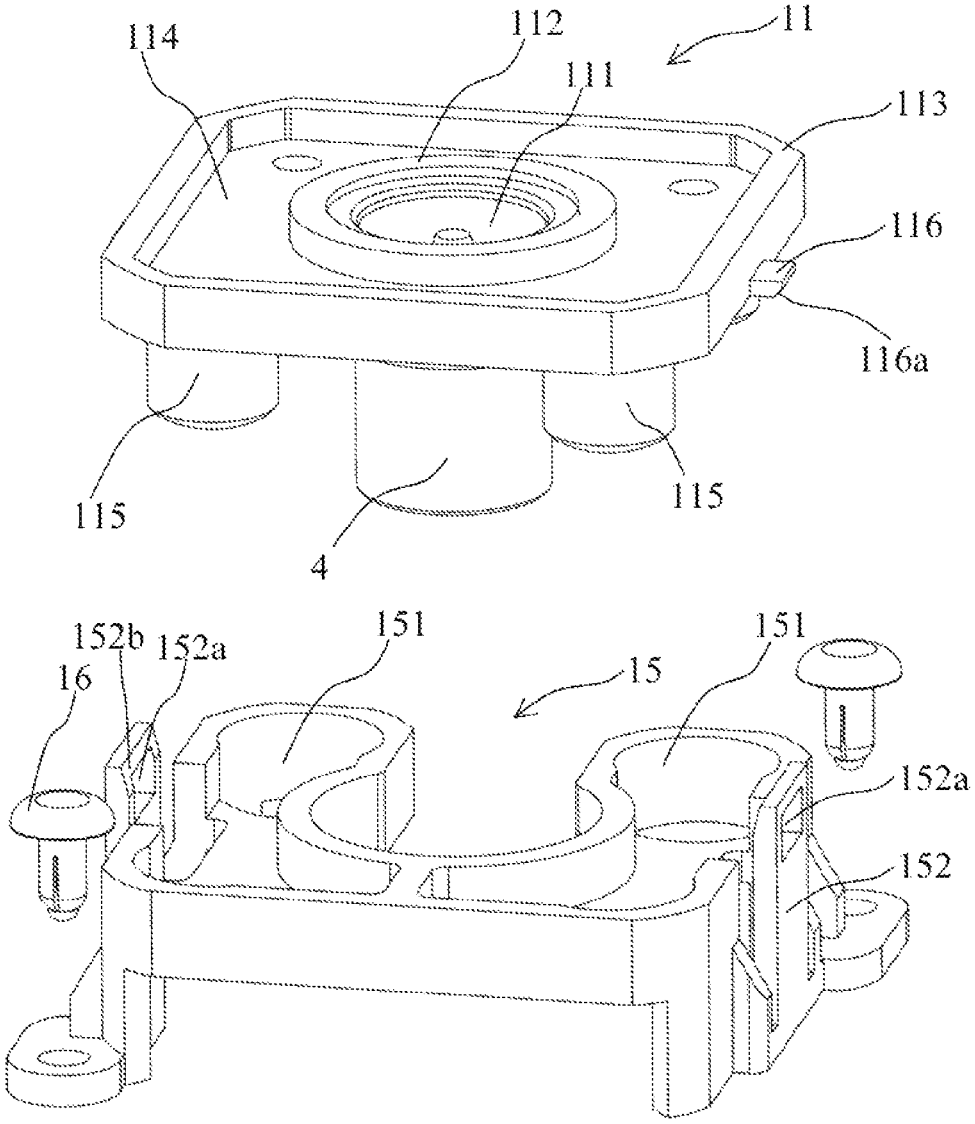
FIG. 1B shows an exploded view of a mounting structure of the present disclosure.

Referring to FIG. 1A and FIG. 1B, the mounting structure 10 according to the present disclosure comprises a main body portion 11, which defines a hollow cavity 111 for receiving the connector 4 and is made of metal; a first flange 112 arranged on an upper surface of the main body portion 11 around the hollow cavity 112; and a second flange 113 arranged on the upper surface of the main body portion 11 around the first flange 112 and spaced apart from the first flange 112. The second flange 113 may be slightly lower than the first flange 112, so that only the first flange 112 is in contact with the lower surface of the frame 3.

Still referring to FIG. 1A and FIG. 1B, the mounting structure 10 comprises a protective pad 12 and an adhesion component 13, wherein the adhesion component 13 is used for adhering the protective pad 12 into a protective pad receiving portion 114 defined between the first flange 112 and the second flange 113. The protective pad 12 may be received in the protective pad receiving portion 114 in a fitted manner. In some embodiments, the protective pad 12 may be made of a waterproof material capable of elastic deformation. Four bolts 14 are screwed into four threaded holes of the main body portion 11 after penetrating through the frame 3, the protective pad 12 and the adhesion component 13 for fastening the mounting structure 10 to the frame 3, so that the first flange 112 comes into direct contact with the lower surface of the frame 3 and compresses the protective pad 12 so as to achieve reliable anti-electromagnetic interference performance and dustproof and waterproof performance.

It should be noted that four bolts 14 are shown in FIG. 1A, but it should be understood that the number of the fasteners of the present disclosure is not limited to four, and the fasteners are not limited to the bolts, but any number and any type of fasteners can be used, as long as the mounting structure 10 can be fastened to the frame 3.

In addition, although the main body portion 11 shown in FIG. 1A and FIG. 1B is approximately of a square structure, it should be understood that the shape of the main body portion 11 is not limited to the approximately square structure, but can be any proper shape.

The mounting structure 10 of the present disclosure may further comprise a supporting component 15 made of a plastic material, and the supporting component 15 may be fixed to the bracket 2 of the antenna device 1 via rivets.

As the frame 3 is connected to the mounting structure 10 in the last step of the assembly process, in order to accurately fix the main body portion 11 installed with the connector 4 to the frame 3 via the bolts 14, the main body portion 11 (including the placed protective pad 12 and adhesion component 13) needs to be movable in the horizontal and vertical directions before the frame 3 is mounted; that is, the main body portion 11 needs to keep a "floating" locking state in the supporting component 15 before the frame 3 is mounted.

In order to keep the "floating" locking state of the main body portion 11 in the supporting component 15 before the frame 3 is mounted, two vertical locating columns 115, preferably being approximately cylindrical, are arranged on the lower surface of the main body portion 11, and a horizontal locating projection 116 (only the horizontal locating projection 116 on one side wall is shown in FIG. 1A and FIG. 1B) is arranged on each of two opposite side walls. Correspondingly, two locating holes 151 for receiving the vertical locating columns 115 are formed in the supporting component 15, and the vertical locating columns 115 are in clearance fit in the locating holes 151. In addition, the supporting component 15 is further provided with two elastic arms 152 extending upward from the supporting component 15, horizontal locating holes 152*a* are formed in the elastic arms 152, and the horizontal locating projections 116 are in interference fit in the horizontal locating holes 152*a*. The elastic arms 152 can deform, so that the elastic arms 152 can be forced to open by pressing the main body portion 11 downward so as to receive the vertical locating columns 115 in the locating holes 151 in an interference fit and to receive the horizontal locating projections 116 in the horizontal locating holes 152*a* in an interference fit. By means of the interference fit described above, the main body portion 11 can keep the "floating" locking state in the supporting component 15; therefore, when the frame 3 is mounted, the threaded hole in the main body portion 11 can move to a position accurately aligned to the threaded hole of the frame 3 so as to achieve the accurate mounting of the connector 4, and the mounting work is simplified.

In order to cause the elastic arm 152 to open by pressing the horizontal locating projection 116, the horizontal locating projection 116 is provided with an inclined surface 116*a*, and correspondingly, the elastic arm 152 is provided with an inclined surface 152*b*. Therefore, when the main body portion 11 is pressed downward, the inclined surface 116*a* pushes and presses the inclined surface 152*b* along an outward direction, so that the elastic arm 152 opens outward. It should be understood that it is possible to provide only one of the inclined surface 116*a* and the inclined surface 152*b*.

As the antenna device comprises at least one row of connectors, each row of connectors including multiple connectors (for example, each row of connectors comprises eight connectors), and these connectors need to be fixed to the same frame 3 via respective mounting structures 10; thus, the capability of the main body portion 11 to keep the "floating" locking state in the supporting component 15 is particularly beneficial for the assembly of the antenna device. Specifically, due to the "floating" feature, the position of each mounting structure 10 can be adjusted independently from any other mounting structures, thereby enabling the accurate alignment of the threaded hole in the main body portion 11 of the mounting structure 10 and the hole in the frame 3. When the antenna device comprises multiple rows of connectors (referring to FIG. 3 for example), the beneficial effects provided by the feature mentioned above are more prominent.

It needs to be noted that, although FIG. 1A and FIG. 1B show the main body portion 11 is provided with two approximately cylindrical vertical locating columns 115, it should be understood that the shapes, the numbers and the arrangement modes of the vertical locating columns 115 and the corresponding locating holes 151 are not limited to the specific solution shown in FIG. 1, but locating columns and locating holes with any shapes, any numbers and any arrangement modes can be used. Similarly, the shapes, the numbers and the arrangement modes of the horizontal locating projections 116 and the corresponding horizontal locating holes 152*a* are not limited to the specific solution shown in FIG. 1, but horizontal locating projections and locating holes with any shapes, any numbers and any arrangement modes can be used. In addition, it is also possible that only the horizontal locating projections 116 are provided, and the vertical locating columns 115 are not provided.

A method for assembling the antenna device 1 of the present disclosure will be described below in detail. The described method is not limited to be applied to the antenna device 1 of the specific type as shown in FIG. 1, but also can be applied to any other types of antenna devices.

In the first step, the supporting component 15 is mounted to the bracket 2 via rivets 16 for an example.

In the second step, the protective pad 12 is adhered into the protective pad receiving portion 114 of the main body portion 11 via the adhesion component 13.

It should be understood that the first step and the second step described above can be executed in any sequence.

Then, in the third step, the main body portion 11 provided with the protective pad 12 and the connector 4 is pushed and pressed into the supporting component 15, so that the vertical locating columns 115 are received in the two locating holes 151 as an interference fit, and the horizontal locating projections 116 are received in the corresponding horizontal locating holes 152*a* as an interference fit so as to lock the main body portion 11 into the supporting component 15 in the "floating" manner.

The steps mentioned above are repeated, until all mounting structures 10 are mounted.

Finally, in the fourth step, the main body portion 11 is self centered and fastened to the frame 3 via the bolts 14 so as to properly compress the protective pad 12, so that the first flange 112 comes into direct contact with the lower surface of the frame 3, and thus reliable anti-electromagnetic interference performance and protection performance are achieved. In addition, it is conceivable that gaskets, such as gaskets made of a plastic material, are arranged on the second flange 113 and the lower surface of the frame 3 to further improve the protection performance.

The method may further comprise: providing at least one connector 4, wherein the connector 4 is located, integrally with the main body portion 11, in the hollow cavity 111 of the main body portion 11, or the connector 4 is inserted into the hollow cavity 111 of the main body portion 11 as a separate component as an interference fit.

As mentioned above, due to the "floating" feature, the position of each mounting structure 10 can be adjusted independently from any other mounting structures, thereby ensuring the accurate alignment of the threaded hole in the main body portion 11 of the mounting structure 10 and the hole in the frame 3. Therefore, the assembly work of the antenna device is simplified.

It needs be noted that although the mounting structure of the present disclosure has been described above in combination with the specific example of the sector antenna, it should be understood that the mounting structure of the present disclosure is not limited to be applied to the field of antenna, but can be applied to all other fields requiring reliable anti-electromagnetic interference performance and dustproof and waterproof performance.

Although the exemplary embodiments of the present disclosure have been described above, those skilled in the art should understand that many changes and modifications can be made to the exemplary embodiments of the present disclosure without essentially departing from the spirit and scope of the present disclosure. Therefore, all the changes and modifications shall fall within the protection scope of the present disclosure defined by the claims. The present disclosure is defined by the appended claims, and the equivalents of these claims are also encompassed.

The invention claimed is:

1. A mounting structure for mounting a connector to a first fixing part and a second fixing part, by comprising:

a main body portion which defines: a hollow cavity for receiving the connector; a first flange arranged on an upper surface of the main body portion around the hollow cavity; and a second flange arranged on the upper surface of the main body portion around the first flange and spaced apart from the first flange;

a protective pad received in a protective pad receiving portion defined between the first flange and the second flange;

a supporting component to be fixed to the second fixing part, the main body portion being fitted within the supporting component; and at least one fastener used for fastening the mounting structure to the first fixing part, so that the first flange comes into direct contact with a lower surface of the first fixing part;

wherein the mounting structure further comprises at least one vertical locating portion arranged on a lower surface of the main body portion, and the at least one vertical locating portion is in clearance fit with at least one vertical location fit portion arranged in the supporting component, so that the at least one vertical locating portion is movable in at least one direction relative to the at least one vertical location fit portion.

2. The mounting structure of claim 1, wherein a top of the second flange is slightly lower than a top of the first flange, so that after the at least one fastener fastens the mounting structure to the first fixing part, only the first flange is in direct contact with the lower surface of the first fixing part.

3. The mounting structure of claim 1, wherein the mounting structure further comprises an adhesion component used for adhering the protective pad into the protective pad receiving portion.

4. The mounting structure of claim 1 in combination with the connector, wherein the connector is in interference fit in the hollow cavity or is integrally formed within the hollow cavity with the main body portion.

5. The mounting structure of claim 1, wherein the main body portion is made of metal.

6. The mounting structure of claim 1, wherein the supporting component is made of a plastic material.

7. The mounting structure of claim 1, wherein the connector is in conductive contact with the main body portion.

8. An antenna device comprising:

the at least one mounting structure of claim 1; and the first fixing part and the second fixing part;

wherein the at least one mounting structure fixes the connector to the first fixing part and the second fixing part.

9. The antenna device of claim 8, wherein the antenna device comprises multiple rows of mounting structures for fixing multiple rows of connectors to the first fixing part and the second fixing part.

10. A method for assembling an antenna device, comprising the following steps:

1) providing at least one mounting structure of claim 1;

2) fixing the supporting component to the second fixing part;

3) placing the protective pad into the protective pad receiving portion;

4) inserting the main body portion into the supporting component; and 5) fastening the first fixing part to the main body portion via the at least one fastener;

wherein the step 1) comprises providing the at least one vertical locating portion arranged on the lower surface of the main body portion, the at least one vertical locating portion is able to in clearance fit with the at least one vertical location fit portion arranged in the supporting component, and wherein the step 4) further comprises the following steps: forming clearance fit between the at least one vertical locating portion and the at least one vertical location fit portion arranged in the supporting component, so that the at least one vertical locating portion is movable in the at least one direction relative to the at least one vertical location fit portion.

11. The method of claim 10, wherein the step 1) comprises providing an adhesion component used for adhering the protective pad into the protective pad receiving portion, and the step 3) comprises: adhering the protective pad into the protective pad receiving portion via the adhesion component.

12. The method of claim 10, wherein prior to the step 5), the steps 1) to 4) are repeated.

13. The method of claim 10, wherein the method further comprises providing at least one connector, wherein the connector is located, integrally with the main body portion, in the hollow cavity of the main body portion, or the connector is inserted into the hollow cavity of the main body portion as a separate component in an interference fit manner.

14. A mounting structure for mounting a connector to a first fixing part and a second fixing part, comprising:

a main body portion which defines: a hollow cavity for receiving the connector; a first flange arranged on an upper surface of the main body portion around the hollow cavity; and a second flange arranged on the upper surface of the main body portion around the first flange and spaced apart from the first flange;

a protective pad received in a protective pad receiving portion defined between the first flange and the second flange;

a supporting component to be fixed to the second fixing part, the main body portion being fitted within the supporting component; and at least one fastener used for fastening the mounting structure to the first fixing part, so that the first flange comes into direct contact with a lower surface of the first fixing part;

at least one horizontal locating portion arranged on a side face of the main body portion; and at least one elastic arm extending upward from the supporting component, wherein a horizontal location fit portion is arranged on the elastic arm, and the at least one horizontal locating portion is in clearance fit with the horizontal location fit portion, so that the at least one horizontal locating portion is movable in at least one direction relative to the at least one horizontal location fit portion.

15. A method for assembling an antenna device, comprising the following steps:

1) providing at least one mounting structure of claim 1;

2) fixing the supporting component to the second fixing part;

3) placing the protective pad into the protective pad receiving portion;

4) inserting the main body portion into the supporting component; and 5) fastening the first fixing part to the main body portion via the at least one fastener;

wherein the step 1) comprises providing at least one horizontal locating portion arranged on a side face of the main body portion and providing at least one elastic arm extending upward from the supporting component, wherein a horizontal location fit portion is arranged on the elastic arm, and the at least one horizontal locating portion is able to in clearance fit with the horizontal location fit portion, and wherein the step 4) further comprises the following steps: forming clearance fit between the at least one horizontal locating portion and the horizontal location fit portion, so that the at least one horizontal locating portion is movable in the at least one direction relative to the at least one horizontal location fit portion.

* * * * *